US009591952B2

(12) United States Patent
Conrad

(10) Patent No.: US 9,591,952 B2
(45) Date of Patent: Mar. 14, 2017

(54) HAND VACUUM CLEANER WITH REMOVABLE DIRT CHAMBER

(75) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 676 days.

(21) Appl. No.: 13/255,858

(22) PCT Filed: Mar. 9, 2010

(86) PCT No.: PCT/CA2010/000340

§ 371 (c)(1),
(2), (4) Date: Sep. 9, 2011

(87) PCT Pub. No.: WO2010/102394

PCT Pub. Date: Sep. 16, 2010

(65) Prior Publication Data

US 2011/0314630 A1 Dec. 29, 2011

(30) Foreign Application Priority Data

Mar. 11, 2009 (CA) ..... 2658029
Mar. 11, 2009 (CA) ..... 2658048

(51) Int. Cl.

| | |
|---|---|
| ***A47L 5/24*** | (2006.01) |
| ***A47L 9/00*** | (2006.01) |
| ***A47L 9/10*** | (2006.01) |
| ***A47L 9/16*** | (2006.01) |

(52) U.S. Cl.

CPC *A47L 5/24* (2013.01); *A47L 9/00* (2013.01); *A47L 9/106* (2013.01); *A47L 9/1691* (2013.01)

(58) Field of Classification Search

CPC ..... A47L 5/24
USPC ..... 15/344, 353, 329
See application file for complete search history.

(56) References Cited

U.S. PATENT DOCUMENTS

| | | | | |
|---|---|---|---|---|
| 280,033 | A | | 6/1883 | Hadley |
| 303,173 | A | | 8/1884 | Mark |
| 3,320,727 | A | | 5/1967 | Farley et al. |
| 3,543,325 | A | | 12/1970 | Hamrick et al. |
| 4,279,355 | A | * | 7/1981 | Schwartz et al. ..... 220/300 |
| 4,523,936 | A | | 6/1985 | Disanza |
| D280,033 | S | | 8/1985 | Miyamoto et al. |
| D290,894 | S | | 7/1987 | Miyamoto et al. |

(Continued)

FOREIGN PATENT DOCUMENTS

| | | |
|---|---|---|
| CN | 201523596 U | 7/2010 |
| DE | 202005020767 U1 | 8/2006 |

(Continued)

OTHER PUBLICATIONS

International Search Report received on the corresponding international application No. PCT/CA2010/000340.

(Continued)

*Primary Examiner* — Larry E Waggle, Jr.
*Assistant Examiner* — Henry Hong
(74) *Attorney, Agent, or Firm* — Philip C. Mendes da Costa; Bereskin & Parr LLP/S.E.N.C.R.L., s.r.l.

(57) ABSTRACT

A hand surface cleaning apparatus comprises at least one cyclone and at least one dirt collection chamber The dirt collection chamber may be removable from the surface cleaning apparatus as a sealed unit for emptying and/or the dirt collection chamber may be removable with the nozzle.

26 Claims, 9 Drawing Sheets

(56) References Cited

U.S. PATENT DOCUMENTS

| | | | | |
|---|---|---|---|---|
| D298,875 | S | 12/1988 | Nakamura | |
| D303,173 | S | 8/1989 | Miyamoto et al. | |
| 5,035,024 | A | 7/1991 | Steiner et al. | |
| 5,287,591 | A | 2/1994 | Rench et al. | |
| 5,307,538 | A | 5/1994 | Rench et al. | |
| 5,363,535 | A | 11/1994 | Rench et al. | |
| D353,917 | S | 12/1994 | Hoekstra et al. | |
| 5,379,483 | A | 1/1995 | Pino | |
| 5,839,157 | A * | 11/1998 | Strauser et al. | 15/347 |
| D436,699 | S | 1/2001 | Makihara et al. | |
| 6,228,260 | B1 | 5/2001 | Conrad et al. | |
| 6,375,696 | B2 | 4/2002 | Weglin et al. | |
| 6,406,505 | B1 | 6/2002 | Oh et al. | |
| 6,546,592 | B1 * | 4/2003 | Cockburn et al. | 15/344 |
| 6,613,129 | B2 | 9/2003 | Gen | |
| D498,027 | S | 11/2004 | Alrush et al. | |
| 6,840,972 | B1 | 1/2005 | Kim | |
| 6,883,202 | B2 | 4/2005 | Steffen et al. | |
| 6,974,488 | B2 | 12/2005 | Dyson | |
| 6,991,666 | B2 | 1/2006 | Organ | |
| 7,028,369 | B2 | 4/2006 | Park | |
| 7,370,387 | B2 | 5/2008 | Walker et al. | |
| 7,445,655 | B2 | 11/2008 | Bock et al. | |
| 7,485,164 | B2 * | 2/2009 | Jeong | A47L 9/1625 55/337 |
| D591,466 | S | 4/2009 | Crawley | |
| 7,526,833 | B2 | 5/2009 | Cochran et al. | |
| 7,544,224 | B2 | 6/2009 | Tanner et al. | |
| 7,845,046 | B2 * | 12/2010 | Milligan | A47L 5/24 15/352 |
| 7,887,612 | B2 | 2/2011 | Conrad | |
| D635,728 | S | 4/2011 | Fjellman | |
| 7,931,716 | B2 | 4/2011 | Oakham | |
| 8,117,712 | B2 | 2/2012 | Dyson et al. | |
| 8,127,398 | B2 | 3/2012 | Conrad | |
| 8,156,609 | B2 | 4/2012 | Milne et al. | |
| 8,220,109 | B2 * | 7/2012 | Medema | A47L 5/24 15/415.1 |
| 8,236,077 | B2 | 8/2012 | Gomiciaga-Pereda et al. | |
| 8,302,250 | B2 | 11/2012 | Dyson et al. | |
| 8,347,455 | B2 | 1/2013 | Dyson et al. | |
| 8,387,204 | B2 | 3/2013 | Dyson | |
| 8,424,154 | B2 * | 4/2013 | Beskow | A47L 5/24 15/352 |
| 8,707,513 | B2 | 4/2014 | Ivarsson et al. | |
| 2001/0023517 | A1 | 9/2001 | Onishi et al. | |
| 2004/0020005 | A1 | 2/2004 | Odachi et al. | |
| 2004/0163201 | A1 * | 8/2004 | Murphy | A47L 5/36 15/327.2 |
| 2004/0216264 | A1 * | 11/2004 | Shaver | A47L 5/14 15/344 |
| 2006/0075598 | A1 * | 4/2006 | Follegot et al. | 15/344 |
| 2006/0090290 | A1 * | 5/2006 | Lau | A47L 5/24 15/344 |
| 2006/0123590 | A1 | 6/2006 | Fester et al. | |
| 2006/0130448 | A1 | 6/2006 | Han et al. | |
| 2006/0137309 | A1 | 6/2006 | Jeong et al. | |
| 2006/0156508 | A1 * | 7/2006 | Khalil | 15/353 |
| 2006/0207055 | A1 | 9/2006 | Ivarsson et al. | |
| 2007/0067943 | A1 | 3/2007 | Makarov | |
| 2007/0079473 | A1 * | 4/2007 | Min et al. | 15/353 |
| 2007/0143953 | A1 | 6/2007 | Hwang et al. | |
| 2007/0246579 | A1 * | 10/2007 | Blateri | 239/599 |
| 2007/0271724 | A1 * | 11/2007 | Hakan | A47L 5/225 15/329 |
| 2007/0289266 | A1 * | 12/2007 | Oh | 55/337 |
| 2008/0040883 | A1 * | 2/2008 | Beskow | A47L 5/225 15/329 |
| 2008/0047091 | A1 | 2/2008 | Nguyen | |
| 2008/0109972 | A1 * | 5/2008 | Mah et al. | 15/1.7 |
| 2008/0134460 | A1 * | 6/2008 | Conrad | 15/335 |
| 2008/0250601 | A1 * | 10/2008 | Coburn | 15/352 |
| 2009/0056290 | A1 * | 3/2009 | Oh et al. | 55/337 |
| 2009/0165239 | A1 * | 7/2009 | Frantzen et al. | 15/344 |
| 2009/0165242 | A1 | 7/2009 | Lee et al. | |
| 2009/0265877 | A1 * | 10/2009 | Dyson | A47L 5/24 15/344 |
| 2009/0282639 | A1 * | 11/2009 | Dyson | A47L 5/24 15/344 |
| 2009/0313958 | A1 | 12/2009 | Gomiciaga-Pereda et al. | |
| 2010/0154150 | A1 | 6/2010 | McLeod | |
| 2011/0219566 | A1 | 9/2011 | Dyson et al. | |
| 2011/0219571 | A1 | 9/2011 | Dyson et al. | |
| 2012/0030896 | A1 | 2/2012 | Crouch et al. | |
| 2012/0079671 | A1 | 4/2012 | Stickney et al. | |

FOREIGN PATENT DOCUMENTS

| | | | |
|---|---|---|---|
| EP | 0489468 | A1 | 6/1992 |
| EP | 1356755 | A2 | 10/2003 |
| EP | 1938736 | | 7/2008 |
| EP | 1356755 | B1 | 5/2012 |
| GB | 2035787 | | 10/1982 |
| GB | 2251178 | A | 7/1992 |
| GB | 2268875 | A | 1/1994 |
| GB | 2377880 | A | 1/2003 |
| GB | 2409404 | B | 11/2005 |
| GB | 2441962 | A | 3/2008 |
| GB | 2466290 | A | 6/2010 |
| GB | 2478614 | B | 2/2012 |
| GB | 2484146 | B | 2/2013 |
| GB | 2478599 | | 7/2014 |
| JP | 609203 | | 9/1983 |
| JP | 745201 | | 10/1983 |
| JP | 649078 | | 4/1985 |
| JP | 6049084 | | 4/1985 |
| JP | 60-220027 | A | 11/1985 |
| JP | 679295 | | 5/1986 |
| JP | 679390 | | 5/1986 |
| JP | 679426 | | 5/1986 |
| JP | 679806 | | 5/1986 |
| JP | 61131720 | | 6/1986 |
| JP | 706192 | | 5/1987 |
| JP | 706193 | | 5/1987 |
| JP | 725983 | | 2/1988 |
| JP | 726042 | | 3/1988 |
| JP | 726318 | | 3/1988 |
| JP | 743059 | | 9/1988 |
| JP | 743445 | | 9/1988 |
| JP | 743603 | | 9/1988 |
| JP | 743618 | | 9/1988 |
| JP | 743619 | | 9/1988 |
| JP | 63-246116 | A | 10/1988 |
| JP | 745200 | | 10/1988 |
| JP | 943287 | | 11/1988 |
| JP | 6415020 | | 1/1989 |
| JP | 787941 | | 5/1990 |
| JP | 788426 | | 5/1990 |
| JP | 788427 | | 5/1990 |
| JP | 8289861 | A | 11/1996 |
| JP | 2000083879 | | 3/2000 |
| JP | 1115813 | | 7/2001 |
| JP | 1310024 | | 9/2007 |
| JP | 1370915 | | 10/2009 |
| KR | 300360565 | | 9/2004 |
| WO | 2004069021 | | 8/2004 |
| WO | 2007/104138 | | 9/2007 |
| WO | 2008/009883 | | 1/2008 |
| WO | 2008/009888 | | 1/2008 |
| WO | 2008/009890 | | 1/2008 |
| WO | 2008009888 | | 1/2008 |
| WO | WO 2008/009887 | * | 3/2008 |
| WO | 2012042240 | | 4/2012 |

OTHER PUBLICATIONS

What's the Best vacuum.com Forum discussion Dyson DC16 Root 6 Hand Held Vacuum Cleaner; http://www.abbysguide.com/vacuum/legacy/cgi-bin/yabb/2618~YaBB.html; dated Oct. 21, 2006.

(56) References Cited

OTHER PUBLICATIONS

"Instruction Manual for Cordless Cleaner", Makita, , pp. 1-32.

* cited by examiner

HAND VACUUM CLEANER WITH REMOVABLE DIRT CHAMBER

The specification relates to hand carried surface cleaning apparatus such as vacuum cleaners, and particularly, to cyclonic hand vacuum cleaners. More specifically, the specification relates to hand vacuum cleaners having a removable dirt chamber.

INTRODUCTION

The following is not an admission that anything discussed below is prior art or part of the common general knowledge of persons skilled in the art.

PCT publication WO 2008/009890 (Dyson Technology Limited) discloses a handheld cleaning appliance comprising a main body, a dirty air inlet, a clean air outlet and a cyclonic separator for separating dirt and dust from an airflow. The cyclone separator is located in an airflow path leading from the air inlet to the air outlet. The cyclonic separator is arranged in a generally upright orientation (i.e., the air rotates about a generally vertical axis in use). A base surface of the main body and a base surface of the cyclonic separator together form a base surface of the appliance for supporting the appliance on a surface. See also PCT publication WO 2008/009888 (Dyson Technology Limited) and PCT publication WO 2008/009883 (Dyson Technology Limited).

U.S. Pat. No. 7,370,387 (Black & Decker Inc.) discloses a hand-holdable vacuum cleaner that uses one or more filters and/or cyclonic separation device, and means for adjusting an angle of air inlet relative to a main axis of said vacuum cleaner. In particular, the vacuum cleaner further comprises a rigid, elongate nose having the air inlet at one end thereof, the nose being pivotal relative to a main axis of the vacuum cleaner through an angle of at least 135 degrees.

SUMMARY

The following introduction is provided to introduce the reader to the more detailed discussion to follow. The introduction is not intended to limit or define the claims.

According to one broad aspect, a hand surface cleaning apparatus is disclosed having a simplified structure for emptying the surface cleaning apparatus. The hand surface cleaning apparatus is preferably a cyclonic surface cleaning apparatus wherein the dirt chamber is removable as a sealed unit from the surface cleaning apparatus. The dirt chamber may be part of a cyclone (e.g., the lower portion of a cyclone chamber) and removable with the cyclone. Alternately, the dirt chamber may be external to the cyclone chamber and removable from the hand surface cleaning apparatus by itself. In either case, the dirt collection chamber is closed (other than, e.g., an air inlet, an air outlet, a dirt outlet) when removed from the hand surface cleaning apparatus. The dirt chamber may be openable, such as by an openable or removable lid or door. Accordingly, dirt collected in the chamber may be transported to a disposal site (e.g., a garbage can) without the dirt being dispersed as the dirt collection chamber is conveyed to the disposal site.

Another advantage of this design is that the dirt chamber, and the cyclone if removed with the dirt chamber, may be washed or immersed in water without concern that the motor of the hand surface cleaning apparatus may be damaged. The portion of the hand surface cleaning apparatus may be dried and then remounted to the hand surface cleaning apparatus so that the hand surface cleaning apparatus is then ready for further use.

In some examples, the hand surface cleaning apparatus may comprise an air flow passage extending from a dirty air inlet to a clean air outlet with a first cyclone unit positioned in the air flow passage. The first cyclone unit may comprise at least one cyclone and at least one dirt collection chamber. The dirt collection chamber may be a portion of the cyclone casing (e.g., a lower portion of a cyclone chamber or a chamber external to the cyclone casing and connected in flow communication with the cyclone chamber via a dirt outlet of the cyclone chamber. The dirt collection chamber is removable from the surface cleaning apparatus as a sealed unit for emptying. A suction motor is positioned in the air flow passage.

In some examples, the dirt collection chamber is removable from the hand surface cleaning apparatus with the first cyclone unit. The first cyclone unit may be sealed when removed from the hand surface cleaning apparatus other than fluid flow passages leading to and from the first cyclone unit.

In some examples, the first cyclone unit has a single cyclone and the dirt collection chamber is positioned exterior to the single cyclone. The cyclone and the dirt collection chamber may comprise a one-piece assembly, and may be integrally formed. For example, the dirt chamber and the cyclone chamber may be produced in a single mold, together optionally with an end wall. The other end, e.g., the bottom of the dirt chamber, may be closed by an openable door.

In some examples, the hand surface cleaning apparatus comprises a suction motor housing, the suction motor is positioned in the suction motor housing, and the first cyclone unit is removably mounted to the suction motor housing.

In some examples, the cyclone unit has a first mounting member, the suction motor housing has a second mounting member, and the first and second mounting members are rotationally secured together. Preferably, a bayonet mount is used. However, a screw mount or other means, such as latches or other hand operable releasable mechanical fasteners, may be used.

In some examples, the at least one dirt collection chamber is openable when mounted to the hand surface cleaning apparatus.

In some examples, the hand surface cleaning apparatus has a front end and a rear end, the first cyclone unit is positioned forward of the suction motor housing, and the at least one dirt collection chamber has an openable door positioned at the front end.

In some examples, the hand surface cleaning apparatus further comprises an airflow chamber extending from a dirty air inlet to the cyclone wherein the airflow chamber is removable with the first cyclone unit. The airflow chamber may be integrally formed as part of the first cyclone unit.

In some examples, the first cyclone unit has a single cyclone and a single dirt collection chamber. In other examples, the hand surface cleaning apparatus further comprises a second cyclone unit downstream from the first cyclone unit.

According to another broad aspect, a hand surface cleaning apparatus is disclosed that is easier to clean and has a simplified structure. In accordance with this aspect, a hand surface cleaning apparatus is provided with a dirt collection chamber and a nozzle. The nozzle and the dirt collection chamber may be integrally molded together or separately manufactured and then assembled together as a one-piece assembly. In either embodiment, the nozzle and the dirt collection chamber may then be removed concurrently (e.g., in a single operation) from the hand surface cleaning apparatus. Once removed, the dirt collection chamber may be emptied. During operation, dirt may build up in the nozzle of the surface cleaning apparatus and/or the dirt collection chamber. These components once separated from the hand surface cleaning apparatus may be cleaned by, for example, washing them in water.

In a preferred embodiment, the dirt collection chamber is removable in a sealed configuration. For example, a cyclone unit may comprise a cyclone and a dirt collection chamber assembly, The assembly may be removably mounted to the hand surface cleaning apparatus. Accordingly, the dirt collection chamber may be closed (e.g., have a closed lid) when removed from the hand surface cleaning apparatus.

A further advantage of this design is that the hand surface cleaning apparatus may have a simplified structure. By providing the nozzle as part of the dirt collection chamber, and preferably as part of a cyclone unit, such an assembly may be removably mounted to a motor housing. Accordingly, a skeleton or backbone to which individual components are mounted is not required and is preferably not used. Such a design may be lighter, permitting a user to use the hand surface cleaning apparatus for a longer continuous period of time.

Accordingly, for example, the hand surface cleaning apparatus may comprise an air flow passage extending from a nozzle having a dirty air inlet to a clean air outlet, with a first cyclone unit is positioned in the air flow passage. The first cyclone unit may comprise at least one cyclone having a cyclone inlet and at least one dirt collection chamber. A suction motor may be positioned in the air flow passage. The dirt collection chamber and the nozzle are removable from the surface cleaning apparatus, preferably concurrently (i.e., by the same operation step).

In some examples, the dirt collection chamber and the nozzle are removable as a unit.

In some examples, the dirt collection chamber and the nozzle comprise a one-piece assembly.

In some examples, the dirt collection chamber and the nozzle are integrally formed, such as being produced from a single mold.

In some examples, the dirt collection chamber is removable from the hand surface cleaning apparatus with the first cyclone unit.

In some examples, the nozzle is connected in airflow communication with the cyclone at a lower portion of the hand surface cleaning apparatus.

In some examples, the nozzle is positioned at a bottom of the hand vacuum.

In some examples, the nozzle is positioned beneath at least a portion of the cyclone unit.

In some examples, the hand surface cleaning apparatus further comprises a plurality of wheels, and the nozzle has a nozzle axis that extends generally horizontally when the wheels are in contact with a surface to be cleaned.

In some examples, the nozzle comprises an enclosed airflow chamber.

In some examples, the nozzle comprises an open sided airflow chamber.

In some examples, the open sided airflow chamber has an open lower end.

In some examples, the open sided airflow chamber has an upper nozzle wall that comprises at least a portion of the lower wall of the cyclone unit.

In some examples, the cyclone inlet is in communication with an enclosed passage extending from an opening in the upper nozzle wall.

In some examples, the open sided airflow chamber further comprises a depending wall extending downwardly from the upper nozzle wall.

In some examples, the depending wall is generally U-shaped.

In some examples, the hand surface cleaning apparatus has a front and the open sided airflow chamber extends to the front of the hand surface cleaning apparatus and the dirty air inlet is at the front of the hand surface cleaning apparatus.

In some examples, the cyclone inlet faces a surface to be cleaned.

In some examples, the open sided airflow chamber comprises an upper wall. A depending wall may extend downwardly from the upper wall. The depending wall may have a lower end that is positioned above the lower end of the wheels. The upper wall and the depending wall may define an airflow chamber having an open lower end. The opening may be provided in a rear half of the upper wall of the air flow chamber forwardly of a rear portion of the depending wall and inwardly of side portions of the depending wall.

It will be appreciated that a hand surface cleaning apparatus may incorporate one or more of the features of each of these examples and that each of these is within the scope of the invention, including the openable front door, the removable screen, the door being at the front of the hand surface cleaning apparatus, the open sided nozzle

DRAWINGS

In the detailed description, reference will be made to the following drawings, in which.

DESCRIPTION OF VARIOUS EXAMPLES

Figure 1:
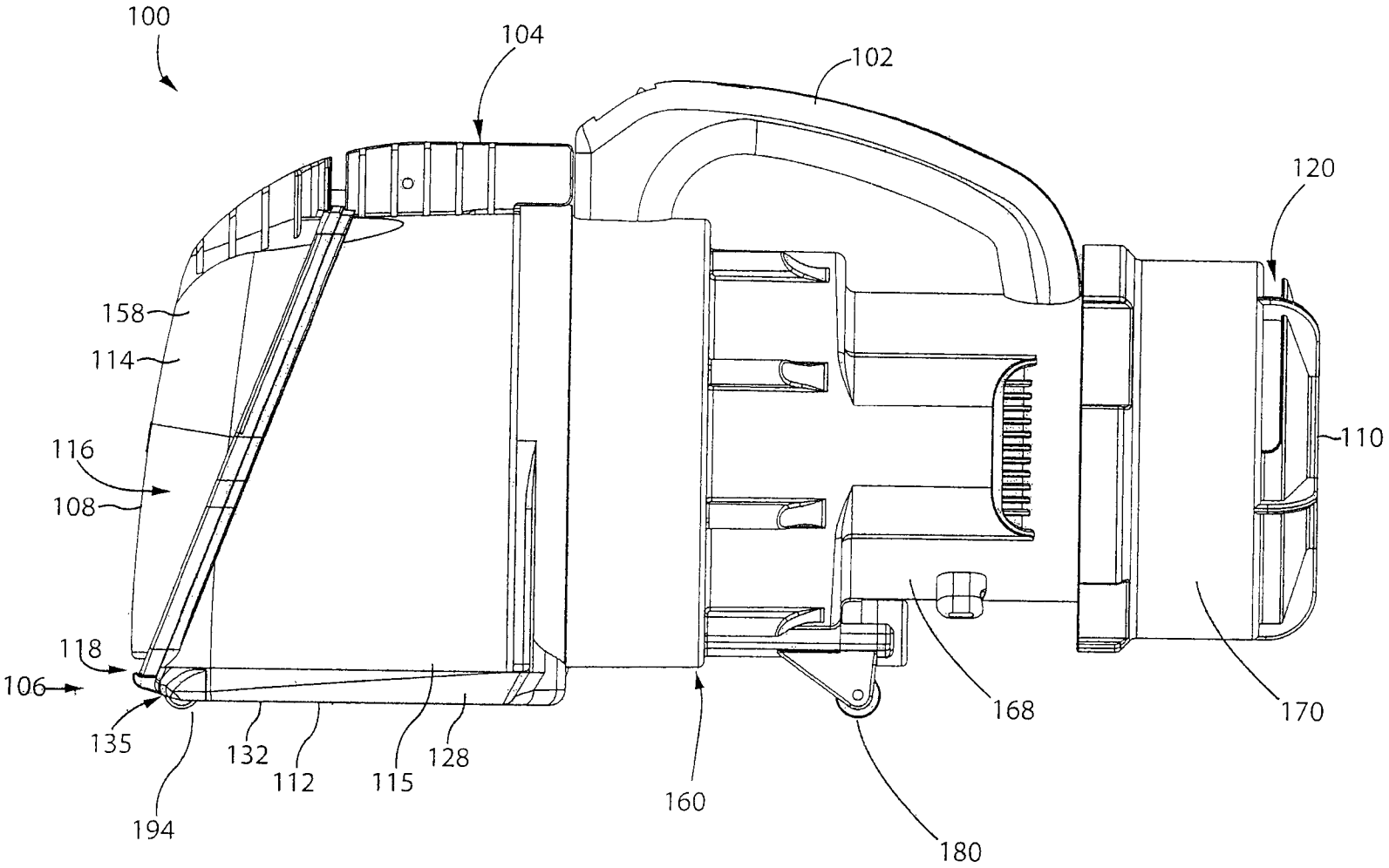
FIG. 1 is a side plan view of an example of a hand vacuum cleaner.
Figure 2:
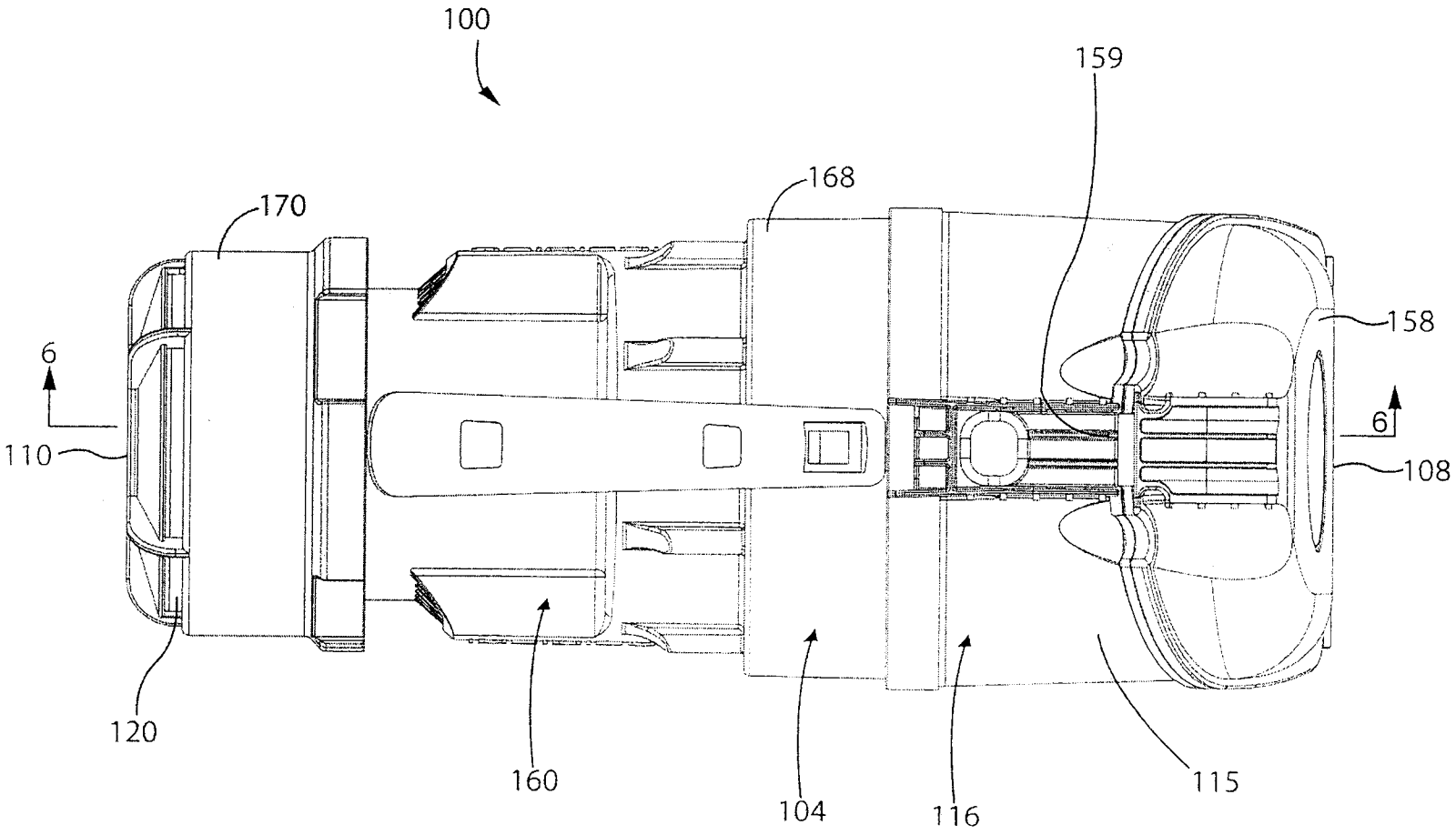
FIG. 2 is a top plan view of the hand vacuum cleaner of FIG. 1.

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below.

In the drawings attached hereto, the surface cleaning apparatus is exemplified as used in a hand vacuum cleaner that uses a single cyclone axially aligned with a longitudinal axis of the hand vacuum cleaner. It will be appreciated that the vacuum cleaner 100 may be of various configurations (e.g., different positioning and orientation of the cyclone unit and the suction motor and differing cyclone units that may comprise one or more cyclones and one or more filters) and different types of surface cleaning apparatus, such as a wet/dry hand held surface cleaning apparatus.

Referring to FIGS. 1 to 7B, a first example of a vacuum cleaner 100 is shown. The vacuum cleaner 100 is a hand vacuum cleaner, and is movable along a surface to be cleaned by gripping and maneuvering handle 102. The vacuum cleaner includes an upper portion 104, a lower portion 106, a front 108, and a rear 110. In the example shown, handle 102 is provided at the upper portion 104. In alternate examples, handle 102 may be provided elsewhere on the vacuum cleaner 100, for example at the rear 110 and may be of any design.

In the example shown, the vacuum cleaner 100 comprises a nozzle 112 and a cyclone unit 114, which, in one embodiment, together form a surface cleaning head 116 of the vacuum cleaner 100. In the example shown, the surface cleaning head 116 is preferably provided at the front 108 of the vacuum cleaner 100.

Nozzle 112 engages a surface to be cleaned, and comprises a dirty air inlet 118, through which dirty air is drawn into the vacuum cleaner 100. An airflow passage extends from the dirty air inlet 118 to a clean air outlet 120 of the cleaner 100. In the example shown, clean air outlet 120 is preferably at the rear 110 of the cleaner 100.

Cyclone unit 114 is provided in the airflow passage, downstream of the dirty air inlet 118. In the example shown, the cyclone unit 114 is a one piece assembly comprising one cyclone 122, and one dirt collection chamber 124, which are preferably integrally formed. In alternate examples, the cyclone unit 110 may include more than one cyclonic stage, wherein each cyclonic stage comprising one or more cyclones and one or more dirt chambers. Accordingly, the cyclones may be arranged in parallel and/or in sequence. Further, in alternate examples, the cyclone 122 and dirt collection chamber 124 may be separately formed.

In the example shown, the nozzle 112 is positioned at the lower portion 106 of the vacuum cleaner 100. Preferably, as exemplified, nozzle 112 is positioned at the bottom of the vacuum cleaner 100, and, preferably, beneath the cyclone unit 114. Further, as exemplified, the nozzle 112 may be integral formed as port of cyclone unit 114 or may be a one-piece assembly therewith (e.g., separately manufactured but assembled together such as by an adhesive or welding to form a single component). Alternately, or in addition, it will be appreciated that nozzle 112 may be connected to the cyclone unit or dirt collection chamber at alternate locations.

Figure 6:
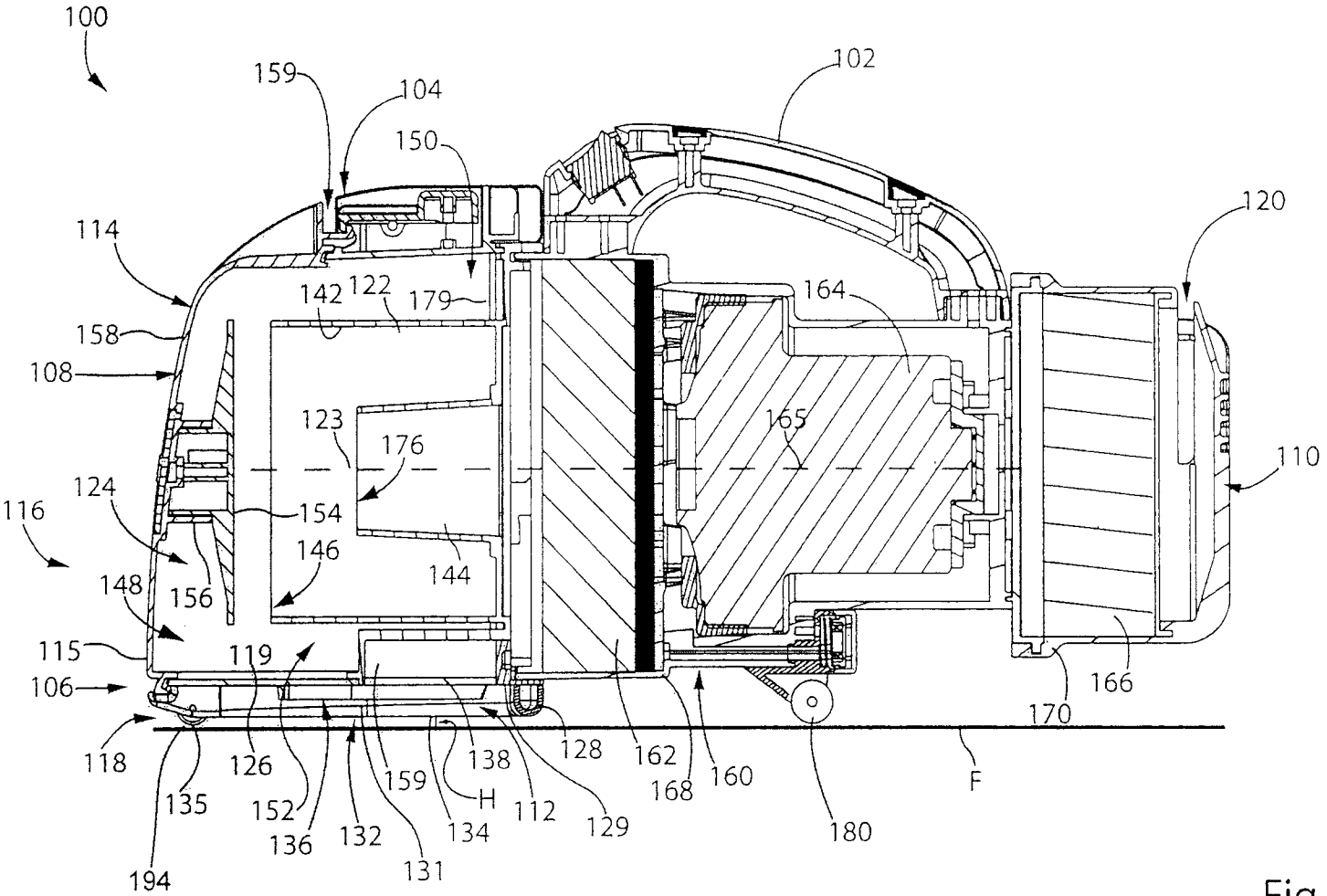
FIG. 6 is a cross section taken along line 6-6 in FIG. 2.

Preferably, as exemplified, nozzle 112 may be on lower surface 157 of cyclone unit 114 and may share a wall with the cyclone unit 114. For example, in a particularly preferred design, the upper wall of the nozzle may be a lower wall of the cyclone unit 114. As shown in FIG. 6, dirt chamber 124 surrounds the lower portion of cyclone 122. Accordingly, the upper wall of nozzle 112 may be part of the lower wall of the dirt chamber. It will be appreciated that if dirt chamber 124 does not extend around the lower portion of cyclone 122, then the upper wall of nozzle 112 may be part of a lower wall of cyclone 122. In alternate embodiments, nozzle 112 and cyclone 122 or dirt chamber 124 need not have a common wall.

Preferably, in the example shown, the nozzle 112 is fixedly positioned at the lower portion 106 of the vacuum cleaner 100. That is, the nozzle 112 is not movable (e.g., rotatable) with respect to the remainder of the vacuum cleaner 100, and is fixed at the lower portion 106 of the vacuum cleaner 100.

Figure 3:
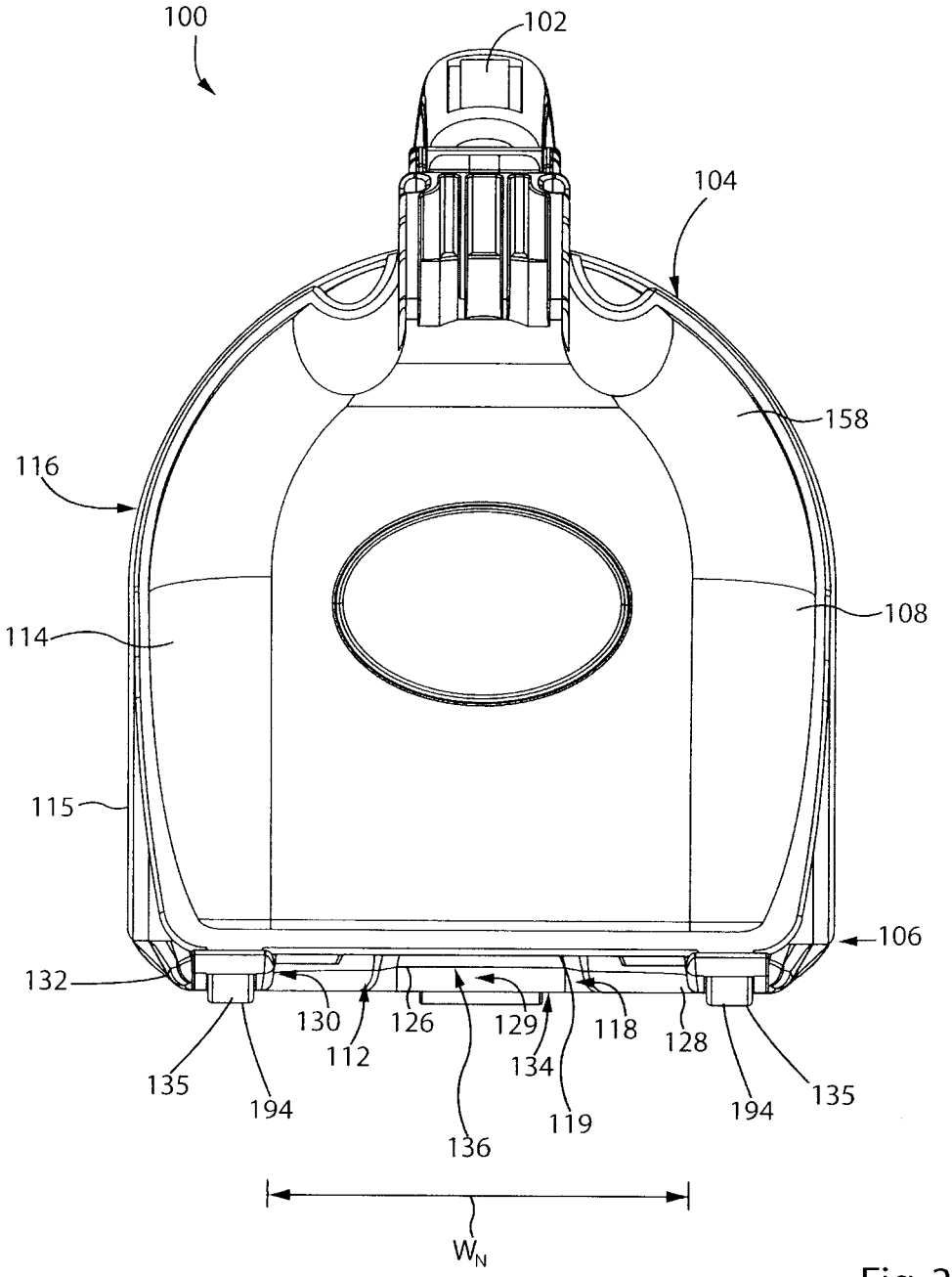
FIG. 3 is a front plan view of the hand vacuum cleaner of FIG. 1.
Figure 5:
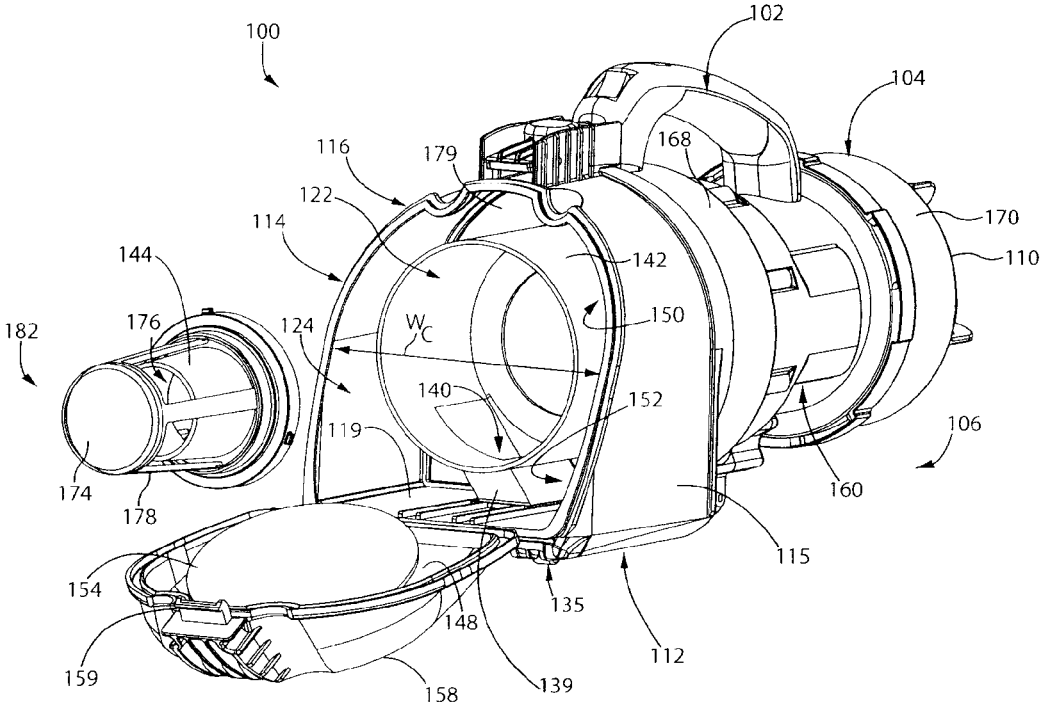
FIG. 5 is a partially exploded front perspective view of the hand vacuum cleaner of FIG. 1.

As shown in FIGS. 3 and 5, nozzle 112 has a width $W_N$, and cyclone unit 114 has a width $W_C$. In the example shown, $W_N$, and $W_C$ are about the same. An advantage of this design is that the nozzle 112 may have a cleaning path that is essentially as wide as the hand vacuum itself.

Preferably, nozzle 112 comprises an airflow chamber 136 wherein at least a portion, and preferably a majority, of the lower surface of the chamber is open (i.e. nozzle 112 is preferably an open sided passage). Such a design is exemplified in FIG. 7A wherein nozzle 112 comprises an upper nozzle wall 126. . In the example shown, the upper nozzle wall 126 comprises a portion 119 of a wall 115 of the cyclone unit. Accordingly, nozzle 112 is integral with cyclone unit 114.

Figure 8:
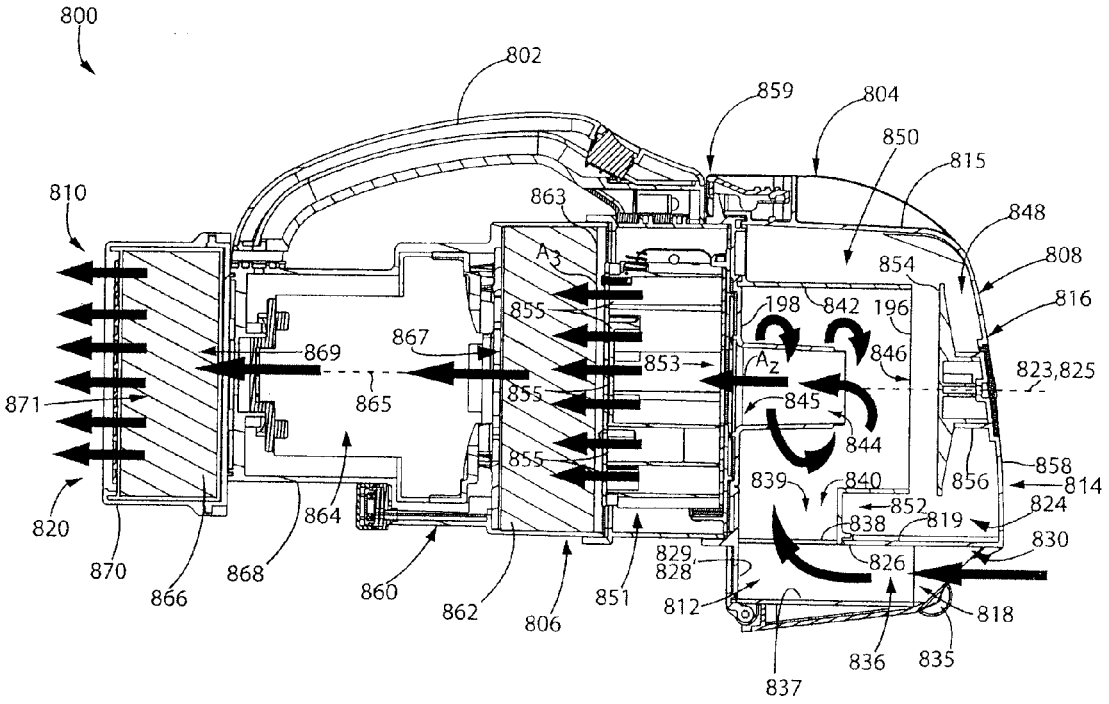

An alternate design as exemplified by FIG. 8, nozzle 812 comprises a lower wall 837, which closes lower end 834. Accordingly, nozzle 112 may be of various designs and may be an open sided passage or a closed passage. In either embodiment, it will be appreciated that nozzle 112 may be mounted or provided on cyclone unit 114 and as exemplified on a lower portion of the dirt collection chamber so as to be removable with the dirt collection chamber.

Preferably, if nozzle 112 is an open sided passage, one or more depending walls 128 extend downwardly from the upper nozzle wall 126. The depending wall is preferably generally U-shaped. In one embodiment, a depending wall is provided rearward of opening 138. In other embodiments, depending walls may alternately or in addition be provided on the lateral sides of opening 138. It is preferred that depending walls are provided on each lateral side of opening 138 and rearward thereof. Further, depending walls 128 may extend a substantial distance to the front end 108 and, preferably, essentially all the way to front end 108. The depending walls may be continuous to define a single wall as shown, or may be discontinuous. The depending walls are preferably rigid (e.g., integrally molded with cyclone unit 114). However, they may be flexible (e.g., bristles or rubber) or moveably mounted to cyclone unit 114 (e.g., hingedly mounted).

Preferably, the lower end 132 of depending wall 128 is spaced above the surface being cleaned when the hand vacuum cleaner is placed on a surface to be cleaned. As exemplified in FIG. 6, when vacuum cleaner 100 is placed on a floor F, lower end 132 of depending wall 128 is spaced a distance H above the floor. Preferably distance H is from 0.01 to 0.175 inches, more preferably from 0.04 to 0.08 inches.

The height of the depending wail (between upper nozzle wall 126 and lower end 132) may vary. In some examples, the depending wall may have a height of between about 0.05 and about 0.875 inches preferably between about 0.125 and about 0.6 inches and more preferably between about 0.2 and about 0.4 inches. The height of depending wall may vary but is preferably constant.

As exemplified, the open end of the U-shape defines an open side 130 of the nozzle 114, and forms the dirty air inlet 118 of the cleaner 100. In the example shown, the open side 130 is provided at the front of the nozzle 114. In use, when optional wheels 135 are in contact with a surface, the open side 130 sits above and is adjacent a surface to be cleaned (e.g. floor F).

In the example shown, the lower end 132 of the depending wall 128 defines an open lower end 134 of the nozzle 114.

The open lower end 134 preferably extends to the front 108 of the cleaner 108, and merges with the open side 130. In use, the exemplified nozzle has an open lower end 134 that faces a surface to be cleaned.

In the example shown, a plurality of wheels 135 are mounted to the depending wall 128. It will be appreciated that wheels 135 are optional. Preferably, wheels 135 are positioned exterior to the airflow path through nozzle 112, e.g., laterally outwardly from depending wall 128. Preferably a pair of front wheels 135 is provided. Preferably, the wheels are located adjacent front 108. Optionally, one or more rear wheels 180 may be provided. In an alternate embodiment, no wheels may be provided If wheels are provided, then preferably the wheels 135, and more specifically the lower end 194 of the wheels 135, extend lower than the lower end 132 of the depending wall 128. That is, the lower end 132 of the depending wall 128 is positioned above the lower end 194 of the wheels 135. Accordingly, in use, when wheels 135 are in contact with a surface, the lower end 132 of the depending wall 128 is spaced from a surface to be cleaned, Accordingly, some air may enter nozzle 114 by passing underneath depending wall 132. In such a case, the primary air entry to nozzle 114 is via open side 130 so that dirty air inlet 118 is the primary air inlet, and the space between the lower end of the depending wall 128 and the surface to be cleaned form a secondary dirty air inlet to the cleaner 100 (i.e. the secondary air inlet is under depending wall 128)

The upper nozzle wall 126, depending wall 128, and open lower end 134 of the nozzle 112 define the open sided airflow chamber 136 of the nozzle. In the example shown, the open sided airflow chamber 136 extends to the front 108 of the cleaner 100. In use, when wheels 135 are in contact with a horizontal surface, the nozzle 112 and the airflow chamber 136 extend generally horizontally, and preferably linearly along a nozzle axis 113 (see FIG. 7A).

If an open sided nozzle 112 is used, then an opening 138 may be provided in the upper nozzle wall 126, in communication with the airflow chamber 136. Opening 138 may be of any size and configuration and at various locations in upper nozzle wall 126. Preferably, opening 138 is positioned in the rear half of upper nozzle wall 126, forwardly of a rear portion 129 of depending wall 128, and inwardly of side portions 131 of depending wall 128. In use, when wheels 135 are in contact with a surface, the opening 138 faces a surface to be cleaned, air enters the dirty air inlet 118, passes horizontally through the airflow chamber 136, and passes into the opening 138. Opening 138 is in communication with a cyclone inlet passage 139, which is enclosed, and which is in communication with a cyclone air inlet 140 of cyclone 122. In use, when wheels 135 are in contact with a surface, cyclone air inlet 140 faces a surface to be cleaned. Accordingly, the nozzle 112 is connected in airflow communication with the cyclone 112 at the lower portion 106 of the cleaner 100.

Cyclone 122 may of any configuration and orientation. Preferably, cyclone 122 comprises a chamber wall 142, which in the example shown, is cylindrical. The cyclone chamber is located inside chamber wall 142. The cyclone 122 extends along an axis 123, which, in the example shown, is preferably parallel to the nozzle axis, and preferably extends generally horizontally when cleaner 100 is in use and wheels 135 are seated on a surface. Cyclone 122 has a front end 196, which is towards, and preferably at the front end 108 of the hand vacuum cleaner and a rear end 198. The cyclone 122 has an air inlet 140 and an air outlet 145 which, preferably are at the same end of cyclone 122 and a dirt outlet is preferably provided at the opposite end. Preferably the air inlet and the air outlet are distal to front end 108 and a dirt outlet is proximate the front end 108. The cyclone air inlet and cyclone air outlet may be of any configuration known in the art and the cyclone air outlet may be covered by a screen or shroud or filter as is known in the art.

As exemplified, the cyclone air inlet 140 is defined by an aperture in the chamber wall 142. As can be seen in FIG. 5, the inlet passage 139 is configured such that air enters the cyclone 122 in a tangential flow path, e.g., passage 139 may be arcuate. The air travels in a cyclonic path in the cyclone, and dirt in the air is separated from the air. The air exits the cyclone via an outlet passage 144, through outlet 145. Outlet 145 is defined in a rear wall 179 of the cyclone unit 114.

As exemplified in FIG. 6, a plate 174 may be provided adjacent outlet passage 144, spaced from and facing the inlet 176 to outlet passage 144. Plate 174 may be mounted to cyclone 122 via legs 178. In the example shown, plate 174, and legs 178 form an assembly 182 that is removably mounted in cyclone 122. In some examples, a screen may be mounted around legs 178.

The dirt that is separated from the air exits the cyclone via dirt outlet 146, and enters dirt collection chamber 124. Dirt collection chamber 124 may be any dirt collection chamber. Preferably, as exemplified, dirt outlet is at the front 196 of the cyclone 122, and further, is at the front end 108 of the cleaner 100. The dirt collection chamber may be internal or external to the cyclone chamber. Preferably, as exemplified, the dirt collection chamber is external. The dirt collection chamber may be in communication with the cyclone chamber by any means known in the art. Accordingly, one or more dirt outlets may be provided. Preferably, the dirt outlet is at the end opposed to the air inlet and, preferably, the dirt outlet is at the front end 108. Preferably, the dirt outlet is at the end opposed to the air inlet and, preferably, the dirt outlet is at the front end 108

In the example shown, dirt collection chamber 124 preferably comprises two portions. A first portion 148 is provided immediately adjacent the dirt outlet 146, and is at the front 108 of the cleaner 100. A second portion 150 is concentric with the cyclone 122. A lower portion 152 of the second portion 150 is below the cyclone. As exemplified, nozzle 112 is positioned below first portion 148, and lower portion 152. Accordingly, dirt chamber 124 may comprise an annular chamber surrounding the cyclone 122.

A separation plate 154 may be provided in the dirt collection chamber 124, adjacent the dirt outlet 146, and in facing relation to the dirt outlet. The separation plate 154 aids in preventing dirt in dirt collection chamber 124 from re-entering cyclone 122. Preferably, plate 154 is spaced from dirt outlet 146 and faces dirt outlet 146. Plate 154 may be mounted by any means to any component in cyclone unit 114. As exemplified, the separation plate is mounted on an arm 156, which extends from a front wall 158 at the front 108 of the cleaner 100.

Cyclone unit 114 may be emptied by any means known in the art. For example, one of the ends of the cyclone unit 114 may be openable. For example, one of the ends of the cyclone unit 114 may be openable. In an embodiment, an openable door may be positioned at the front end of the vacuum cleaner and preferably comprises a front wall thereof. The door may be opened while the cyclone unit or the dirt collection chamber 124 is mounted to the vacuum cleaner. Alternately, or in addition, the door may be opened when the cyclone unit or the dirt collection chamber 124 has been removed from the vacuum cleaner. The door may be openably mounted to the cyclone unit, dirt collection chamber 124 or another portion of vacuum cleaner 100 by any means known in the art. For example, one or more latches 159 may secure the door in position. Alternately, the door may be opened, e.g., pivoted open, and then optionally removable. It will be appreciated that, in an embodiment wherein cyclone unit 114 is not removed as a sealed unit, dirt collection chamber 124 may be removed with nozzle 112.

Figure 4:
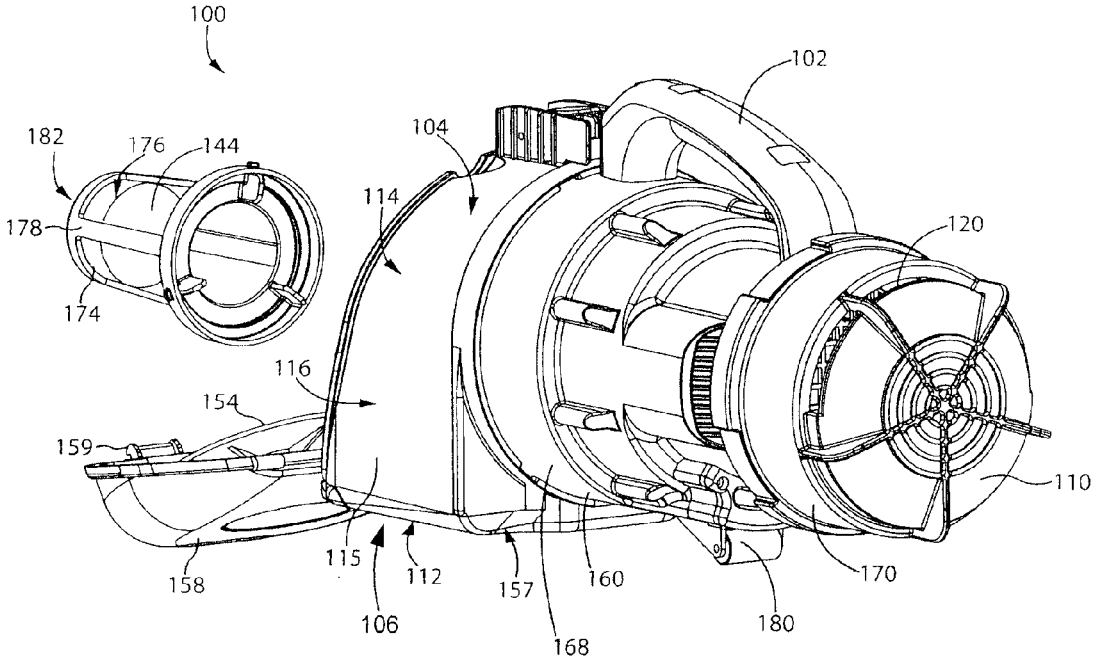
FIG. 4 is a partially exploded rear perspective view of the hand vacuum cleaner of FIG. 1.

As exemplified in FIGS. 4 and 5, front wall 158 is pivotally mounted to the cyclone unit wall 115 and serves as an openable door of the dirt chamber 124, such that dirt collection chamber 124 is openable, and dirt collection chamber 124 may be emptied. The dirt collection chamber is therefore preferably openable both when the dirt collection chamber is mounted to the hand vacuum cleaner, or when it is removed, as will be described hereinbelow. When front wall 158 is pivoted away from the remainder of the cyclone unit 114, separation plate 154 and arm 156 also pivot away from the remainder of the cyclone unit. A latch 159 is provided, which secures front wall 158 to wall 115. In alternate examples, front wall 158 may be removable from cyclone unit wall 115, or the rear wall 179 of the cyclone unit 114 may be openable.

The rear portion of the dirt collection chamber 124 may be closed by wall 179.

The clean air exiting cyclone 122 passes through outlet 145 of outlet passage 144, exits surface cleaning head 116, and passes into the cleaner body 160. In the example shown, the cleaner body 160 is positioned rearward of the surface cleaning head 116. The cleaner body comprises a suction motor housing 168, which houses a suction motor 164 and may also house an optional pre-motor filter 162 and/or an optional post-motor filter 166.

In the example shown, suction motor housing 168 further houses a pre-motor filter 162. Preferably, as shown in the exemplified embodiments, the vacuum cleaner has a linear configuration. Accordingly, pre-motor filter 162 is provided in the airflow path adjacent and downstream of the outlet passage 144, and facing the outlet 145. Pre-motor filter 162 serves to remove remaining particulate matter from air exiting the cyclone 122, and may be any type of filter, such as a foam filter. One or more filters may be used. If the vacuum cleaner is of a non-linear configuration, then pre-motor filter 162 need not be located adjacent outlet passage 144.

Suction motor 164 is provided in the airflow path preferably adjacent and downstream of the pre-motor filter 162. The suction motor 164 may be any type of suction motor. The suction motor draws air into the dirty air inlet 118 of the cleaner 100, through the airflow path past the suction motor 164, and out of the clean air outlet 120. The suction motor 164 has a motor axis 165. In the example shown, the motor axis 165 and the cyclone axis 123 preferably extend in the same direction and are preferably generally parallel. In the exemplified embodiments, the vacuum cleaner has a linear configuration. If the vacuum cleaner is of a non-linear configuration, then motor 164 need not be located adjacent pre-motor filter 162.

The cleaner body 160 preferably further comprises a post-motor filter housing 170. A post motor filter 166 is provided in the post-motor filter housing 170. The post motor filter 166 is provided in the airflow path downstream of, and preferably adjacent, the suction motor 164. Post motor filter 166 serves to remove remaining particulate mater from air exiting the cleaner 100. Post-motor filter 166 may be any type of filter, such as a HEPA filter. If the vacuum cleaner is of a non-linear configuration, then post motor filter 166 need not be located adjacent suction motor 164.

Clean air outlet 120 is provided downstream of post-motor filter 166. Clean air outlet 120 may comprise a plurality of apertures formed in housing 170.

Figure 7A:
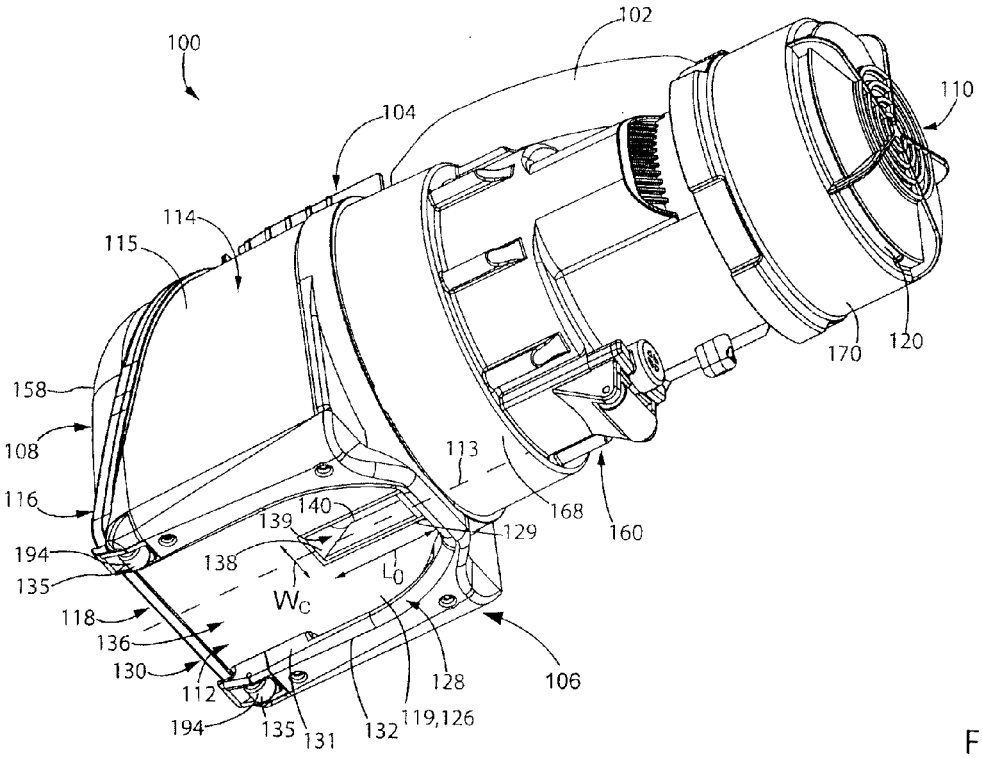
FIG. 7A is a bottom perspective view of the hand vacuum cleaner of FIG. 1.
Figure 7B:
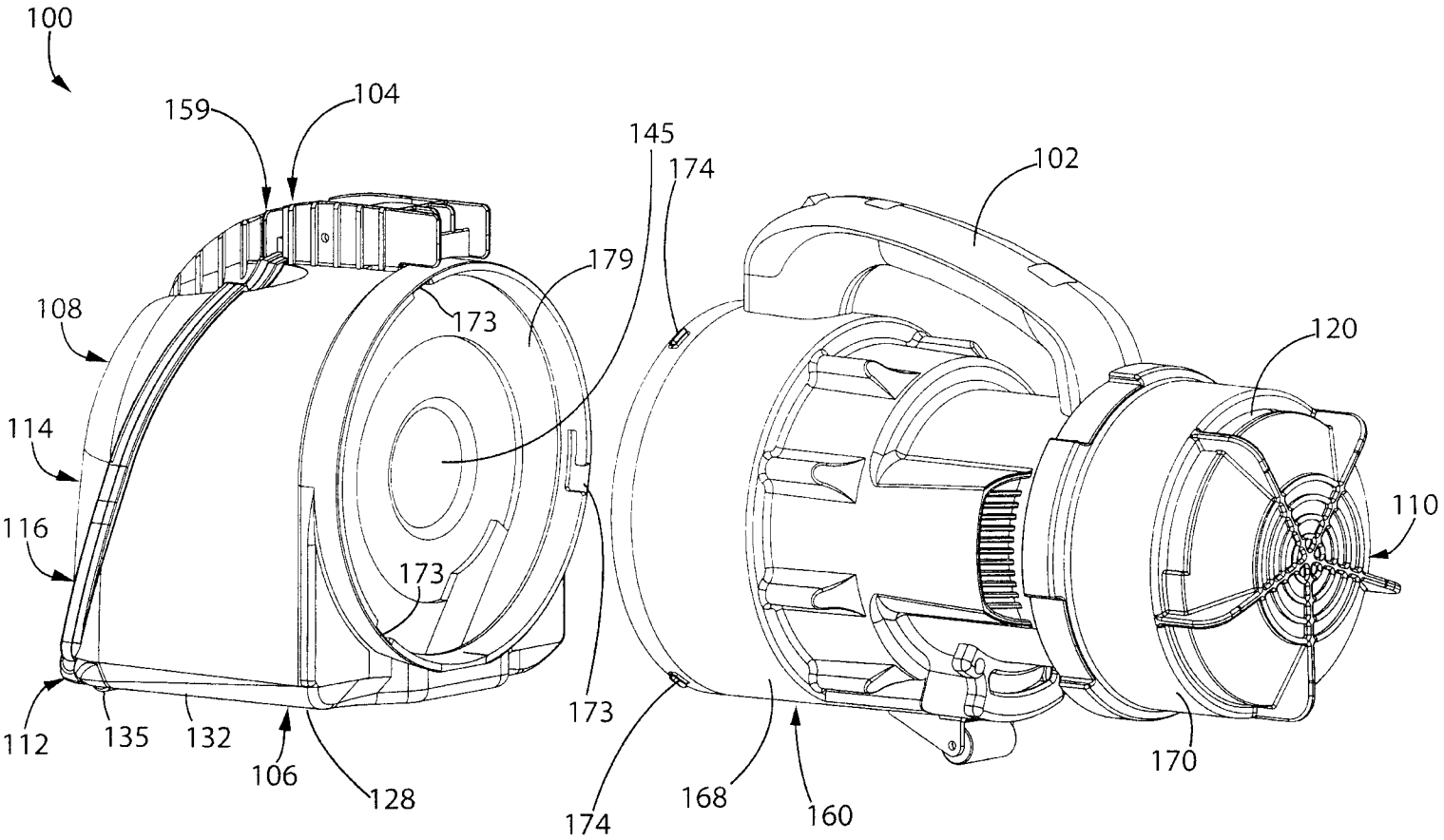
FIG. 7B is a rear perspective view of the hand-vacuum cleaner of FIG. 1, showing the cyclone unit removed from the hand vacuum cleaner; and, FIG. 8 is a cross section showing an alternate example of a hand vacuum cleaner.

As exemplified in FIG. 7B, in one aspect of this invention, the dirt collection chamber 124 is removable from the hand vacuum cleaner 100 as a sealed unit for emptying. It will be appreciated that this aspect may be used by itself or in any particular combination or sub-combination of any one or more of the features set out herein.

In accordance with another aspect of the invention, when cyclone unit 114 is removed from the cleaner 100, nozzle 112 is also removed from the cleaner 100. It will be appreciated that this aspect may be used by itself or in any particular combination or sub-combination of any one or more of the features set out herein. In one particular embodiment, both aspects may be used.

For example, in the example shown, the dirt collection chamber 124 is integrally formed with cyclone wall 142, and with nozzle 112, and the cyclone unit 114 comprises the dirt collection chamber 124. Accordingly, the cyclone unit 114 is removable from the hand vacuum cleaner. As the cyclone unit 114 is integral with nozzle 112 and airflow chamber 136, nozzle 112 and airflow chamber 136 are removable from the cleaner 100 with cyclone unit 114.

In other embodiments, one or more of these components may be separately manufactured and then assembled together (e.g., by an adhesive, mechanical means such as screws or welding, to form a one-piece assembly.

It will be appreciated that if dirt chamber 124 is removably mounted to cyclone unit 114, then nozzle 112 is removable together with dirt chamber 124 from vacuum cleaner 100. It will be appreciated that this aspect may be used by itself or in any particular combination or sub-combination of any one or more of the features set out herein.

In other embodiments, the dirt collection chamber 124 may be removable from the hand vacuum cleaner 100 alone, without the cyclone unit 114 or the nozzle 112.

As can be seen in FIG. 7B, when the cyclone unit 114 is removed from the hand vacuum cleaner, and particularly from motor housing 168, it is sealed, except for the fluid flow passages leading to and from the first cyclone unit (i.e. opening 138 and outlet 145). That is, wall 179 seals the air outlet end of cyclone unit 114 and front wall 158 seals the front end of the cyclone unit 114. In order to empty the dirt collection chamber 124, the front wall 158 or the rear wall 179 may be opened, and the dirt may be emptied from dirt chamber 124.

As exemplified, in order to remove cyclone unit 114 from the surface cleaning apparatus, the cyclone unit comprises a first mounting member 173, and the suction motor housing 168 has a second mounting member 174. The first 173 and second 174 mounting members are releasably engageable with each other. In the example shown, the first 173 and second 174 mounting members comprise a bayonet mount. In alternate examples, the first and second mounting members may be another type of mounting member, such as mating screw threads, magnets, mechanical fasteners such as screws or any other type of mounting members. It will be appreciated that if dirt collection chamber 124 is removably mounted to cyclone unit 114, then any such removable securing mechanism may be used.

Removing the cyclone unit 114 from the hand vacuum cleaner may be advantageous, because it may allow a user to wash the cyclone unit 114, for example using water, without risking wetting and shorting the suction motor 164.

One or more additional wheels 180 may be mounted to housing 161, preferably at lower portion 106, and may be used in conjunction with wheels 135. Preferably, a single rear wheel 180 is provided. Preferably, rear wheel 180 is located on a centre line of the vacuum cleaner and rearward of the depending wall 128.

Referring now to FIG. 8, in which like numerals refer to like features, with the first digit incremented to 8 to refer to the figure number, an alternate example of a hand vacuum cleaner 800 is shown. As discussed previously, nozzle 812 comprises a lower wall 837, which closes lower end 834. Accordingly, in contrast to cleaner 100, nozzle 812 comprises an enclosed airflow passage 836. Further, in this example, front wall 858 is not pivotally mounted to wall 815. Rather, wall surface cleaning head 816 is pivotally mounted to body 860.

Cleaner 800 may further comprise a second optional cyclone unit 851 downstream of the first cyclone unit 814, between first cyclone unit 814 and pre-motor filter 862. In the example shown, the second cyclone unit 851 comprises a plurality of cyclones in parallel. Each of the plurality of cyclones is parallel to the first cyclone axis 823.

The invention claimed is:

1. A hand vacuum cleaner comprising:

a) an air flow passage extending from a dirty air inlet to a clean air outlet;

b) a cleaner body comprising a suction motor housing having a suction motor that is positioned in the air flow passage and a pre-motor filter chamber positioned upstream from the suction motor housing, the suction motor having an air inlet and an axis of rotation, the pre-motor filter chamber having an axially extending sidewall;

c) a cyclone unit positioned in the air flow passage and comprising at least one cyclone having a cyclone air inlet and a cyclone air outlet, and at least one dirt collection chamber wherein the cyclone unit is removable from the cleaner body, wherein the cyclone unit is sealed when removed from the hand vacuum cleaner other than the cyclone air inlet and the cyclone air outlet;

d) a pre-motor filter positioned in the pre-motor filter chamber, the pre-motor filter comprising a porous filter media having an upstream face, a downstream face and a perimeter face extending between the upstream and downstream faces, the pre-motor filter being upstream of the suction motor and overlying the suction motor air inlet, wherein a projection of the axis of rotation extends through the upstream and downstream faces of the pre-motor filter from a downstream side thereof to an upstream side thereof, wherein the pre-motor filter is recessed into the pre-motor filter chamber with the perimeter face facing the axially extending sidewall of the pre-motor filter chamber so that engagement with the axially extending sidewall of the pre-motor filter chamber retains the pre-motor filter in position when the cyclone unit is removed from the cleaner body, and wherein the pre-motor filter is removable from the cleaner body without reconfiguring the hand vacuum cleaner once the cyclone unit is removed from the cleaner body; and, e) a handle having first and second ends each of which is secured to the cleaner body.

2. The hand vacuum cleaner of claim 1, wherein the second end of the handle is provided on the cleaner body adjacent a downstream side of the suction motor.

3. A hand vacuum cleaner comprising:

a) an air flow passage extending from a dirty air inlet to a clean air outlet;

b) a cleaner body comprising a suction motor positioned in the air flow passage;

c) a cyclone unit positioned in the air flow passage and comprising at least one cyclone having a cyclone air inlet and a cyclone air outlet, and at least one dirt collection chamber wherein the cyclone unit is removable from the cleaner body and wherein the cyclone unit is sealed when removed from the hand vacuum cleaner other than the cyclone air inlet and the cyclone air outlet;

d) a handle having frontward and rearward ends, the rearward end being provided on the cleaner body adjacent a downstream side of the suction motor; and, e) a pre-motor filter positioned in the air flow passage upstream of the suction motor, wherein the pre-motor filter is recessed into a compartment formed only by the cleaner body whereby the pre-motor filter remains in position when the cyclone unit is removed from the cleaner body, and wherein the pre-motor filter is removable from the cleaner body without reconfiguring the hand vacuum cleaner once the cyclone unit is removed from the cleaner body.

4. The hand vacuum cleaner of claim 3 wherein the compartment is provided in the cleaner body.

5. The hand vacuum cleaner of claim 4 wherein an upstream side of the pre-motor filter is visible when the cyclone unit is removed from the cleaner body.

6. The hand vacuum cleaner of claim 3 wherein the pre-motor filter overlies a suction motor air inlet.

7. The hand vacuum cleaner of claim 3 wherein the suction motor has an axis of rotation and a projection of the axis of rotation extends through the pre-motor filter from a downstream side thereof to an upstream side thereof.

8. The hand vacuum cleaner of claim 3 wherein the at least one dirt collection chamber is openable when mounted to the hand vacuum cleaner.

9. The hand vacuum cleaner of claim 3 wherein the hand vacuum cleaner has a front end and a rear end, the cyclone unit is positioned forward of the suction motor and the at least one dirt collection chamber has an openable door positioned at the front end.

10. The hand vacuum cleaner of claim 3 wherein the frontward end of the handle is secured to an upper portion of the cleaner body.

11. The hand vacuum cleaner of claim 3 wherein each of the frontward and rearward ends is secured to the cleaner body.

12. The hand vacuum cleaner of claim 3 wherein air exiting the cyclone unit travels in a first direction and air entering the suction motor travels in the first direction.

13. The hand vacuum cleaner of claim 12 wherein air exiting the cyclone air outlet travels in the first direction.

14. A hand vacuum cleaner having a front end and a rear end and comprising:

a) an air flow passage extending from a dirty air inlet to a clean air outlet;

b) a cleaner body comprising a suction motor positioned in the air flow passage and having an axis of rotation;

c) a cyclone unit positioned in the air flow passage and comprising at least one cyclone and at least one dirt collection chamber, the cyclone having a cyclone air inlet, a cyclone air outlet, and a cyclone axis about which air circulates within the cyclone and a projection of the cyclone axis intersects the cleaner body, wherein the cyclone unit includes a first end and a second end, the second end is spaced forwardly from the first end and remains exposed when the hand vacuum cleaner is in use, the cyclone unit is removable from the cleaner body by moving the cyclone unit away from the cleaner body in the absence of reconfiguring other portions of the cleaner body adjacent the second end of the cyclone unit, and wherein the cyclone unit is sealed when removed from the cleaner body other than the cyclone air inlet and the cyclone air outlet; and, d) the hand vacuum cleaner having an axially extending wall that overlies and removably holds a pre-motor filter in position whereby the pre-motor filter remains in position when the cyclone unit is removed from the cleaner body, in all orientations of the cyclone unit, and wherein the pre-motor filter is removable from the cleaner body without reconfiguring the hand vacuum cleaner once the cyclone unit is removed from the cleaner body.

15. The hand vacuum cleaner of claim 14 wherein the axially extending wall is provided on the cleaner body.

16. The hand vacuum cleaner of claim 14 wherein the axially extending wall comprises an outer surface of the hand vacuum cleaner and has an inner surface that abuts the pre-motor filter.

17. The hand vacuum cleaner of claim 14 wherein an upstream side of the pre-motor filter is visible when the cyclone unit is removed from the cleaner body.

18. The hand vacuum cleaner of claim 14 wherein the axially extending wall extends forwardly to a position proximate an upstream face of the pre-motor filter.

19. The hand vacuum cleaner of claim 14 wherein the axially extending wall extends forwardly to a position in front of an upstream face of the pre-motor filter.

20. The hand vacuum cleaner of claim 14 wherein the pre-motor filter overlies a suction motor air inlet.

21. The hand vacuum cleaner of claim 14 wherein a projection of the axis of rotation extends through the pre-motor filter from a downstream side thereof to an upstream side thereof.

22. The hand vacuum cleaner of claim 14 wherein the at least one dirt collection chamber is openable when mounted to the hand vacuum cleaner.

23. The hand vacuum cleaner of claim 14 further comprising a handle having first and second ends and the first end is secured to an upper portion of the cleaner body.

24. The hand vacuum cleaner of claim 14 further comprising a handle having first and second ends each of which is secured to the cleaner body.

25. The hand vacuum cleaner of claim 14 wherein air exiting the cyclone unit travels in a first direction and air entering the suction motor travels in the first direction.

26. The hand vacuum cleaner of claim 25 wherein air exiting the cyclone air outlet travels in the first direction.

* * * * *